US011542770B2

(12) United States Patent
Samuel et al.

(10) Patent No.: US 11,542,770 B2
(45) Date of Patent: Jan. 3, 2023

(54) AGITATOR FOR USE WITH A DRILL STRING

(71) Applicant: Halliburton Energy Services, Inc., Houston, TX (US)

(72) Inventors: Robello Samuel, Cypress, TX (US); Yuan Zhang, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 378 days.

(21) Appl. No.: 16/641,206

(22) PCT Filed: Oct. 24, 2017

(86) PCT No.: PCT/US2017/058153
§ 371 (c)(1),
(2) Date: Feb. 21, 2020

(87) PCT Pub. No.: WO2019/083516
PCT Pub. Date: May 2, 2019

(65) Prior Publication Data
US 2020/0217160 A1 Jul. 9, 2020

(51) Int. Cl.

| | |
|---|---|
| ***E21B 31/00*** | (2006.01) |
| ***B06B 1/16*** | (2006.01) |
| ***B06B 1/18*** | (2006.01) |
| ***E21B 7/24*** | (2006.01) |

(52) U.S. Cl.
CPC ..... *E21B 31/005* (2013.01); *B06B 1/16* (2013.01); *B06B 1/186* (2013.01); *E21B 7/24* (2013.01); *B06B 2201/73* (2013.01)

(58) Field of Classification Search
CPC . E21B 31/005; E21B 7/24; B01B 1/16; B01B 1/186; B01B 2201/73; B06B 1/16; B06B 1/186; B06B 2201/73
See application file for complete search history.

(56) References Cited

U.S. PATENT DOCUMENTS

| | | | | |
|---|---|---|---|---|
| 3,295,837 A * | 1/1967 | Bodine, Jr. | ..... | B06B 1/186 175/57 |
| 3,783,701 A * | 1/1974 | Steprath | ..... | B06B 1/186 74/87 |
| 4,428,678 A * | 1/1984 | Lyle | ..... | E04G 21/08 366/124 |

(Continued)

FOREIGN PATENT DOCUMENTS

WO 2014099789 6/2014

OTHER PUBLICATIONS

ISRWO International Search Report and Written Opinion for PCT/US2017/058153 dated Jul. 3, 2018.

*Primary Examiner* — Christopher J Sebesta
(74) *Attorney, Agent, or Firm* — Benjamin Ford; C. Tumey Law Group PLLC

(57) ABSTRACT

An agitator for vibrating a drill string includes an agitator housing, a rotor and an agitation mass. The drill string has a central axis. The rotor is coupled to the agitator housing and being rotatable about an agitator axis. The agitation mass is coupled to the rotor and is rotatable about the agitator axis. During rotation, a center of mass of the agitation mass is spaced apart from the agitator axis to cause deflection of the agitator axis relative to the central axis to produce vibration in the drill string.

19 Claims, 8 Drawing Sheets

(56) References Cited

U.S. PATENT DOCUMENTS

| | | | | |
|---|---|---|---|---|
| 4,667,742 | A * | 5/1987 | Bodine | E21B 7/24 166/301 |
| 5,771,985 | A * | 6/1998 | Jaworski | E21B 7/24 173/49 |
| 6,023,116 | A * | 2/2000 | Kikuchi | G01M 1/30 310/90.5 |
| 9,167,790 | B1 | 10/2015 | Buffard et al. | |
| 9,279,318 | B2 | 3/2016 | Hay et al. | |
| 9,359,823 | B2 | 6/2016 | Samuel | |
| 9,708,901 | B2 | 7/2017 | Samuel | |
| 9,982,487 | B2 | 5/2018 | Samuel et al. | |
| 10,317,351 | B2 | 6/2019 | Chong et al. | |
| 10,480,249 | B2 | 11/2019 | Samuel et al. | |
| 10,533,375 | B2 | 1/2020 | Robello | |
| 2008/0251254 | A1* | 10/2008 | Lynde | E21B 31/005 166/301 |
| 2010/0212901 | A1 | 8/2010 | Buytaert | |
| 2013/0186686 | A1* | 7/2013 | Heisig | E21B 7/24 175/55 |
| 2014/0069639 | A1 | 3/2014 | Mackenzie et al. | |

* cited by examiner

AGITATOR FOR USE WITH A DRILL STRING

TECHNICAL FIELD

The present description relates in general to downhole tools, and more particularly, for example and without limitation, to downhole tools to produce a vibration in a drill string and methods of use thereof.

BACKGROUND OF THE DISCLOSURE

The friction on a drill string being advanced within the wellbore increases with the length of the drill string and wellbore. The drill string can be progressively lengthened by joining consecutive segments or strands in the process of drilling. The friction may be primarily due to contact between the wall of the wellbore and drill string. The contact between the wall and the drill string can be affected by the wellbore orientation in various sections of the wellbore. For example, vertical sections may provide less contact between the wall and the drill string while bends and non-vertical sections can provide more contact between the wall and the drill string. The friction may also increase due to build-up of solid materials around the drill string. To advance the drill string, a stationary drill string must overcome a static friction force, while a moving drill string must overcome a dynamic friction force, which is lower than the static friction force.

Downhole vibration generating devices are sometimes coupled to the drill string to vibrate the drill string to help maintain movement of the drill string. The vibrations also help prevent the build-up of solid materials around the drill string and prevent the drill string from becoming stuck in the well.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to downhole tools, and more particularly, for example and without limitation, to downhole tools to produce a vibration in a drill string and methods of use thereof.

Downhole axial vibration generating devices utilized in a drill string can allow and maintain movement of the drill string by minimizing friction forces. In some applications, as the length of the drill string increases, a single axial vibration generating device may not be sufficient to minimize friction along the desired portion of the drill string. However, the use of multiple axial vibration generating devices can result in resonance or sympathetic vibration assumed by the drill string, which can damage the drill string.

An aspect of at least some embodiments disclosed herein is that by radially vibrating the drill string, friction forces on the drill string can be decreased. A further aspect, according to at least some embodiments disclosed herein is that by radially vibrating the drill string at a desired location, friction can be reduced at a localized area. Yet another aspect, according to at least some embodiments disclosed herein is that by radially vibrating the drill string, multiple areas can be vibrated without resulting in sympathetic vibrations. Yet another aspect, according to at least some embodiments disclosed herein is that vibrations utilized to reduce drill string friction can be utilized to measure properties of the formation.

The embodiments described herein are directed primarily to a drill string having agitators coupled thereto. However, it should be noted that embodiments disclosed herein are equally applicable to agitators coupled to other types of tubulars being advanced through a wellbore, without departing from the scope of the disclosure.

Figure 1:
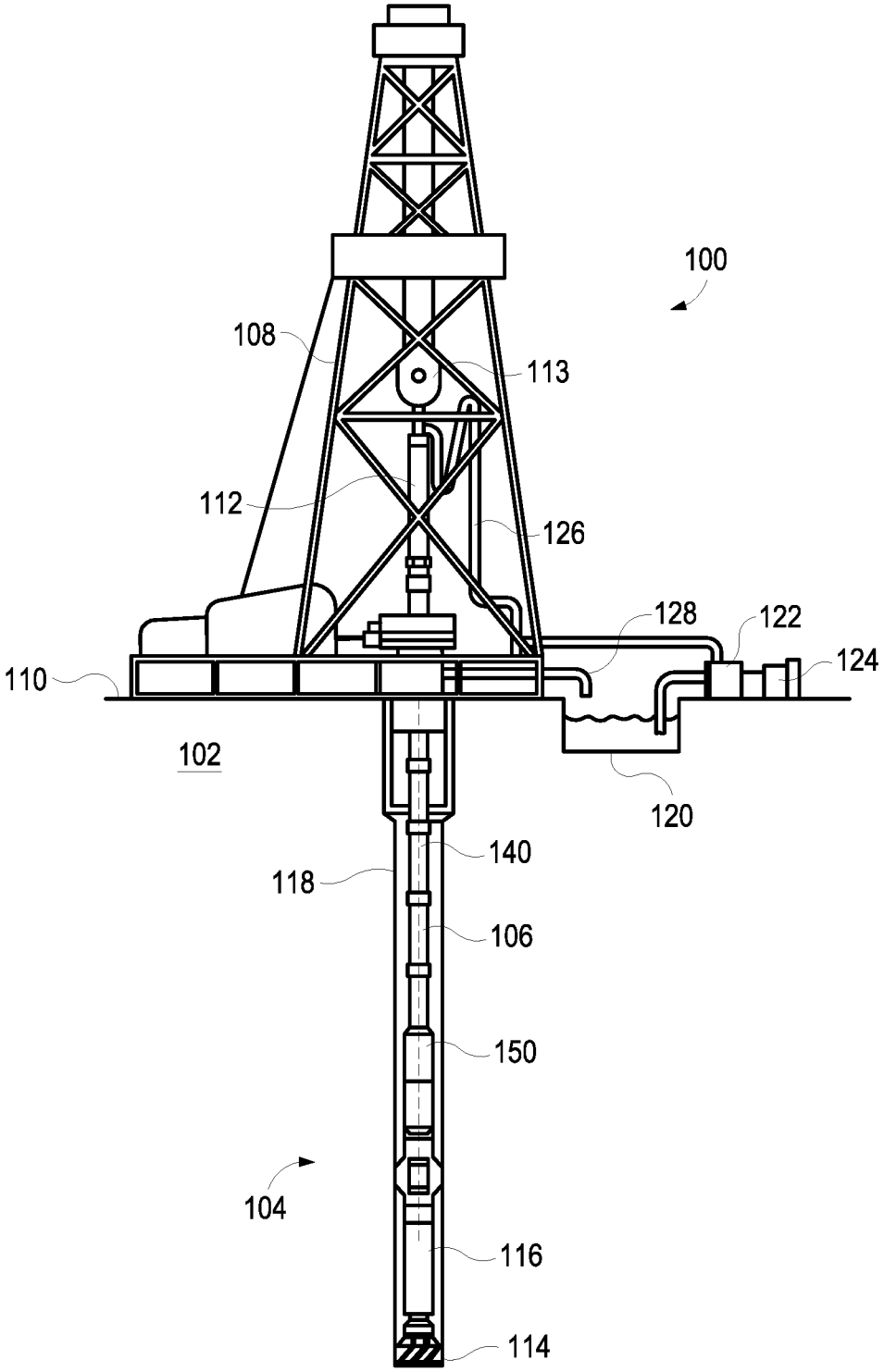
FIG. 1 is an elevation view of an exemplary drilling system that can employ the principles of the present disclosure.

FIG. 1 is an elevation view of an exemplary drilling system that can employ the principles of the present disclosure. Wellbores may be created by drilling into the earth 102 using the drilling system 100. The drilling system 100 may be configured to drive a bottom-hole assembly (BHA) 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process, returns drill cuttings and debris to the surface. The cuttings and mud mixture are passed through a flow line 128 and are processed such that a cleaned mud is returned down hole through the stand pipe 126 once again.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Although the drilling system 100 is shown and described with respect to a vertical wellbore, embodiments of the present disclosure may be applicable to horizontal, deviated, multilateral, u-tube connection, intersection, bypass (drill around a mid-depth stuck fish and back into the well below), or otherwise nonlinear wellbores in any type of subterranean formation.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

As the drill bit 114 and the drill string 106 are advanced within the wellbore 118, one or more agitators 150 can be configured to impart vibration to various portions of the drill string 106. As described herein, in various embodiments, the agitators 150 may be located at a variety of locations, such as adjacent to the drill bit 114 or adjacent to other components, such as a stabilizer or reamer.

Agitators 150 can vibrate portions of the drill string 106 laterally or radially relative to a central axis 140 as described herein. The vibration imparted by the agitators 150 can maintain movement of the drill string 106, which can reduce sliding friction or a drag force of the drill string 106 as the dynamic friction force of the drill string 106 is substantially lower than the static friction force. The drag force Fa is calculated by using the equation:

$$F_d = F_s \times \mu \times \frac{|V_{ts}|}{|V_{rs}|}$$

wherein $V_{ts}$ is the trip speed of the drill string 106 and $V_{rs}$ is the resultant speed of the drill string 106, calculated by:

$$V_{rs}=\sqrt{(V_{ts}^2+\omega^2)}$$

wherein co is the angular speed of the drill string 106. $F_s$ is the side or normal force on the drill string 106, and μ is the coefficient of friction. The coefficient of friction is dependent on material composition and other material properties of the drill string 106 and the formation. Further, the dynamic coefficient of friction of a moving or vibrating drill string is lower than the static coefficient of friction between the drill string 106 and the formation. As shown, by reducing the coefficient of friction, the total drag force is reduced.

Figure 2:
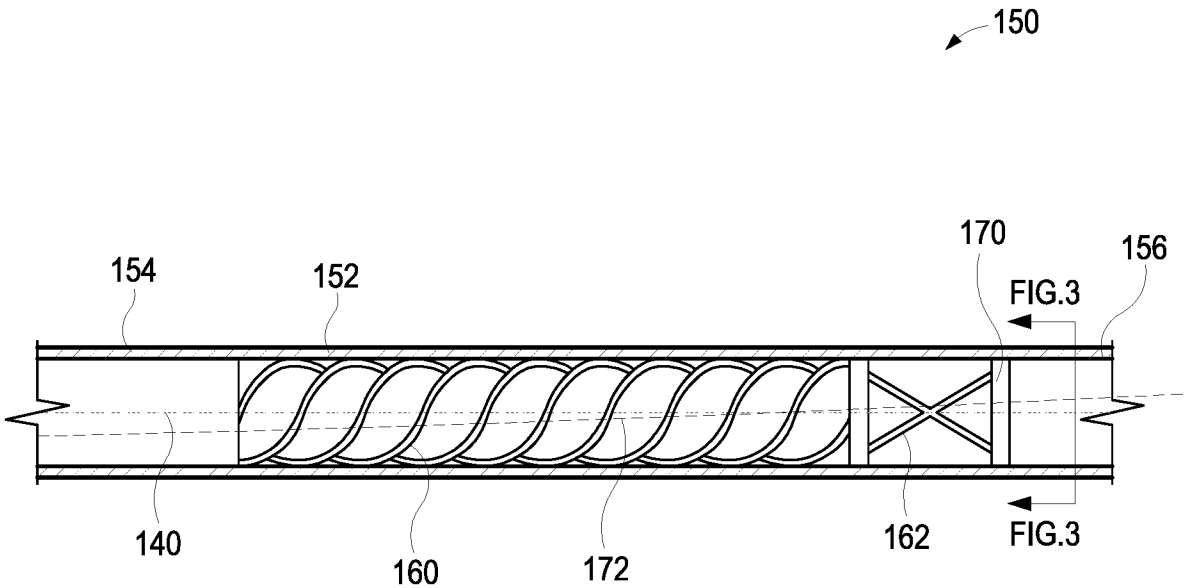
FIG. 2 is a cross-sectional view of an agitator, according to some embodiments of the present disclosure.

FIG. 2 is a cross-sectional view of an agitator, according to some embodiments of the present disclosure. In the depicted example, the agitator 150 includes a rotor 160 disposed within an agitator housing 152 having a first end 154 and a second end 156. The agitator housing 152 can be a portion of the drill string 106 or any other similar tubular. The agitator housing 152 can be coupled to the drill string 106 in-line with other portions of the drill string 106.

In the depicted example, the rotor 160 rotates within the agitator housing 152 to energize or otherwise operate the agitator 150. The rotor 160 is operatively coupled to the agitation mass 170 to rotate the agitation mass 170. The rotor 160 can be a portion of a progressive cavity motor ("mud motor") where a fluid flow through the rotor 160 causes the rotor 160 to rotate. In some embodiments, portions of the agitator housing 152 can act as a stator for operation of the progressive cavity motor. It is understood that in other embodiments, other motors, including electric motors, torque generators, actuators, and other devices can be used in place of the rotor 160.

In some embodiments, the rotor 160 can rotate to provide a concentric rotation motion that can be imparted to the agitation mass 170. In the depicted example, the rotor 160 rotates about an agitator axis 172. The agitator axis 172 can be positioned or oriented to be coincident with the central axis 140 while the agitator 150 is in a rest state, in accordance with some embodiments. However, as discussed below, upon rotation of the rotor 160, the agitator axis 172 can be deflected relative to the central axis 140 to create a vibration in the agitator 150.

Rotation of the rotor 160 can be imparted to the agitation mass 170 by a coupling member 162. The coupling member 162 can rotate with the rotor 160 to provide a rigid or compliant coupling to the agitation mass 170. The coupling member 162 can further space apart the agitation mass 170 from the rotor 160.

In some embodiments, the rotation of the agitation mass 170 can create a rotational imbalance to cause a periodic or random side force or vibration within the agitator 150 that is transferred to the drill string 106. In the depicted example, the side force can deflect the agitator axis 172 relative to the central axis 140 of the drill string 106 as the rotor 160 rotates.

In some embodiments, the vibration created by the agitator 150 can be localized to an immediate area around the agitator 150. Advantageously, by creating localized vibrations, resonance, and sympathetic vibration created by the use of multiple agitators can be avoided to prevent any damage to the drill string 106.

In some embodiments, vibrations generated by the agitator 150 can be used to measure properties of the surrounding formation. Sensors can be disposed on the drill string 106 to receive vibrations created by the agitator 150 and passed through the formation to determine formation properties. Advantageously, the agitator 150 can be utilized in locations to generate vibrations in situations and/or locations where traditional sensors may fail.

Figure 3:
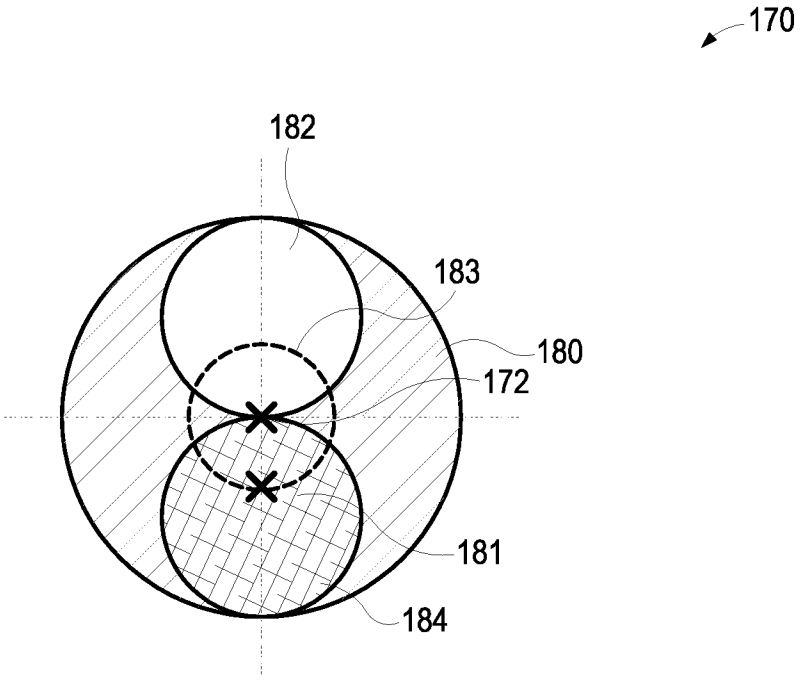
FIG. 3 is a sectional view of the agitator of FIG. 2, according to some embodiments of the present disclosure.

FIG. 3 is a sectional view of the agitator of FIG. 2, according to some embodiments of the present disclosure. In the depicted example, the agitation mass 170 rotates about the agitator axis 172. In the depicted example, the agitation mass 170 has a center of mass 181 spaced apart from the agitator axis 172 to create a periodic side force or an imbalance as the agitation mass 170 rotates.

As the agitation mass 170 rotates, the center of mass 181 follows an eccentric path 183 about the agitator axis 172. The eccentric path 183 of the center of mass 181 urges or forces the agitator axis 172 to deflect from the central axis 140 to create the desired vibration or side force from the agitator 150.

In the depicted example, the agitation mass 170 comprises a weighted disc with a disc body 180. In some embodiments, the center of mass 181 of the disc body 180 is spaced apart from the center of the disc body 180 by altering the weight distribution of the disc body 180 to be eccentrically distributed. In the depicted example, the disc body 180 has an eccentric weight distribution by including a low density portion 182 and a high density portion 184 to allow a greater portion of the weight to be distributed or biased toward the high density portion 184 of the disc body 180 to allow the center of mass 181 to be eccentrically located.

In some embodiments, the low density portion 182 can be formed by altering a material of the disc body 180, removing material from the disc body 180, selecting a lighter or less dense material, or any other suitable method to reduce the density or weight of the low density portion 182. In some embodiments, the high density portion 184 can be formed by altering material of the disc body 180, adding material to portions of the disc body 180, selecting a heavier or more dense material, or any other suitable method to increase the density or weight of the high density portion 184. It is appreciated that multiple low density portions 182 and high density portions 184 can exist, and low density portions 182 and high density portions 184 can be discretely or continuously formed within the disc body 180 while altering the weight distribution and the center of mass 181 from away from the geometric center of the disc body 180.

Figure 4:
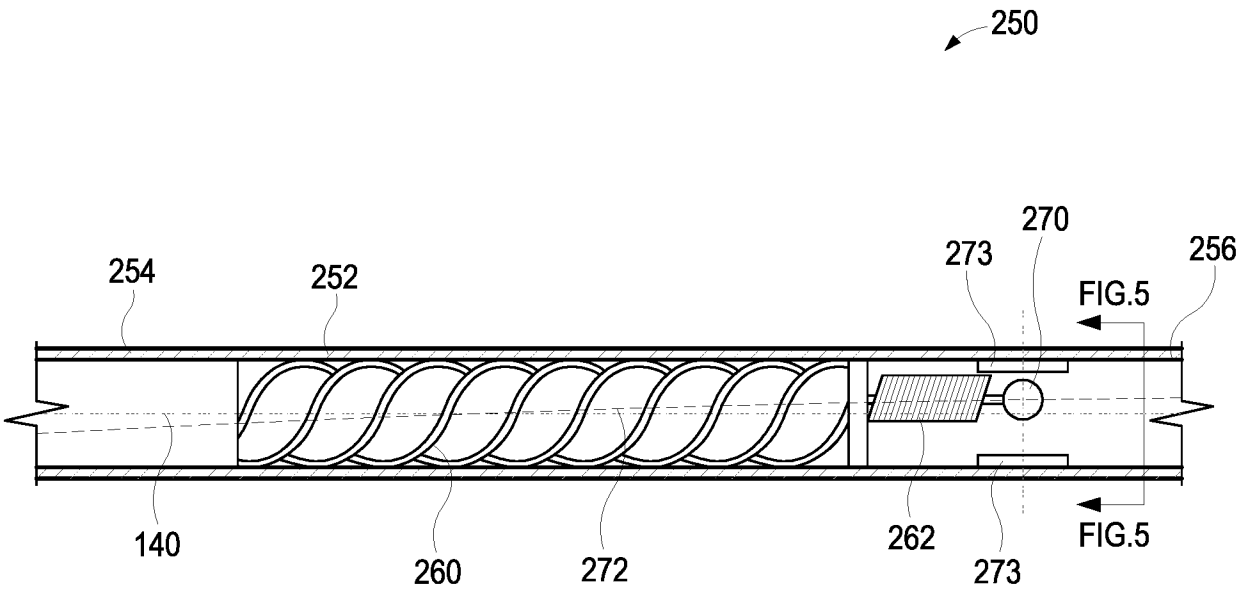
FIG. 4 is a cross-sectional view of an agitator, according to some embodiments of the present disclosure.

FIG. 4 is a cross-sectional view of an agitator 250, according to some embodiments of the present disclosure. Similar numerals from previous figures refer to similar components that are for brevity not described again for brevity. In the depicted example, the agitator 250 includes a moveable agitation mass 270 disposed within an agitator housing 252 having a first end 254 and a second end 256.

Rotation of the rotor 260 can be imparted to the agitation mass 270 by a coupling member 262. The coupling member 262 can rotate with the rotor 260 to provide a coupling to the agitation mass 270. The coupling member 262 can further axially space apart the agitation mass 270 from the rotor 260.

In some embodiments, the agitation mass 270 can define a center of gravity that is offset or radially spaced apart from the central axis 140. The offset agitation mass 270 can create an imbalance or vibration in the agitator 250 when rotated about the central axis 140.

In the depicted example, the coupling member 262 can be compliant to allow the agitation mass 270 to radially move relative to the agitator axis 272 and the central axis 140 as the rotor 260 rotates. In the depicted example, the coupling member 262 comprises a spring coupled to the rotor 260 and the agitation mass 270. In some embodiments, the stiffness of the spring can be selected to allow or provide a desired level of radial movement or deflection of the agitation mass 270 relative to the agitator axis 272.

In some embodiments, the rotation of the agitation mass 270 creates a rotational imbalance to cause a periodic side force or vibration within the agitator 250 that is transferred to the drill string 106. In the depicted example, the agitation mass 270 can impact the anvils 273 as the agitation mass 270 is radially deflected. In the depicted example, the impact and the side force can deflect the agitator axis 272 relative to the central axis 140 of the drill string 106 as the rotor 260 rotates.

Figure 5:
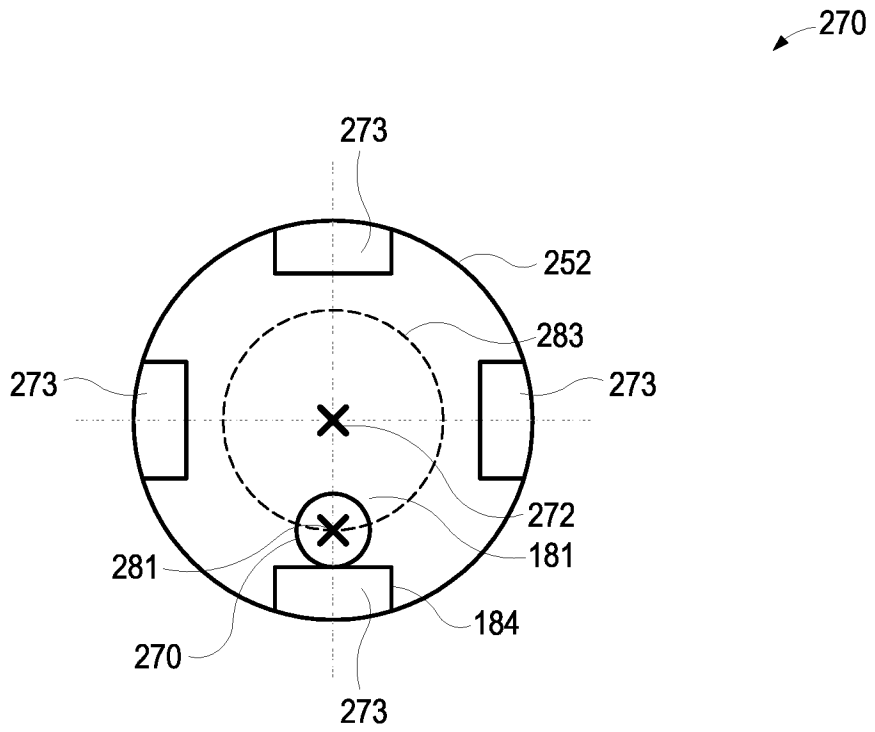
FIG. 5 is a sectional view of the agitator of FIG. 4, according to some embodiments of the present disclosure.

FIG. 5 is a sectional view of the agitator of FIG. 4, according to some embodiments of the present disclosure. In the depicted example, the agitation mass 270 rotates about the agitator axis 272. In the depicted example, as the agitation mass 270 is rotated, the agitation mass 270 is spaced apart from the agitator axis 272 to create a periodic side force or a rotational imbalance as the agitation mass 270 rotates.

As the agitation mass 270 rotates, the agitation mass 270 follows an eccentric path 283 about the agitator axis 272. The eccentric path 283 of the agitation mass 270 urges or forces the agitator axis 272 to deflect away from the central axis 140 to create the desired vibration or side force from the agitator 250.

In the depicted example, as the agitation mass 270 is following the eccentric path 283, the agitation mass 270 can impact the anvils 273 disposed along the inner surface of the agitator housing 252. The impacts of the agitation mass 270 against the agitator housing 252 can further provide the desired vibration or side force from the agitator 250.

In the depicted example, the agitation mass 270 is a weighted sphere. The agitation mass 270 can be formed from any suitable material and can be made from metallic materials suitable for use in downhole environments. In some embodiments, the agitation mass 270 is formed and suitable for impacts with the anvils 273.

In some embodiments, the center of mass 281 of the agitation mass 270 is located at or near the geometric center of the agitation mass 270. In some embodiments, the center of mass 281 is spaced apart from the geometric center of the agitation mass 270.

During rotation of the agitation mass 270, the coupling member 262 allows for the rotational force to urge the agitation mass 270 into the eccentric path 283. In some embodiments, the stiffness of the coupling member 262 can be selected to determine the radius of the eccentric path. Therefore, when the agitation mass 270 is stationary, the center of mass 281 may be concentrically positioned with the agitator axis 272 and the central axis 140. However, as the agitation mass 270 is deflected onto the eccentric path 283, the dynamic center of mass 281 of the agitation mass 270 can be on the eccentric path 283 relative to the agitator axis 272 and the central axis 140 to create a periodic vibration.

Figure 6:
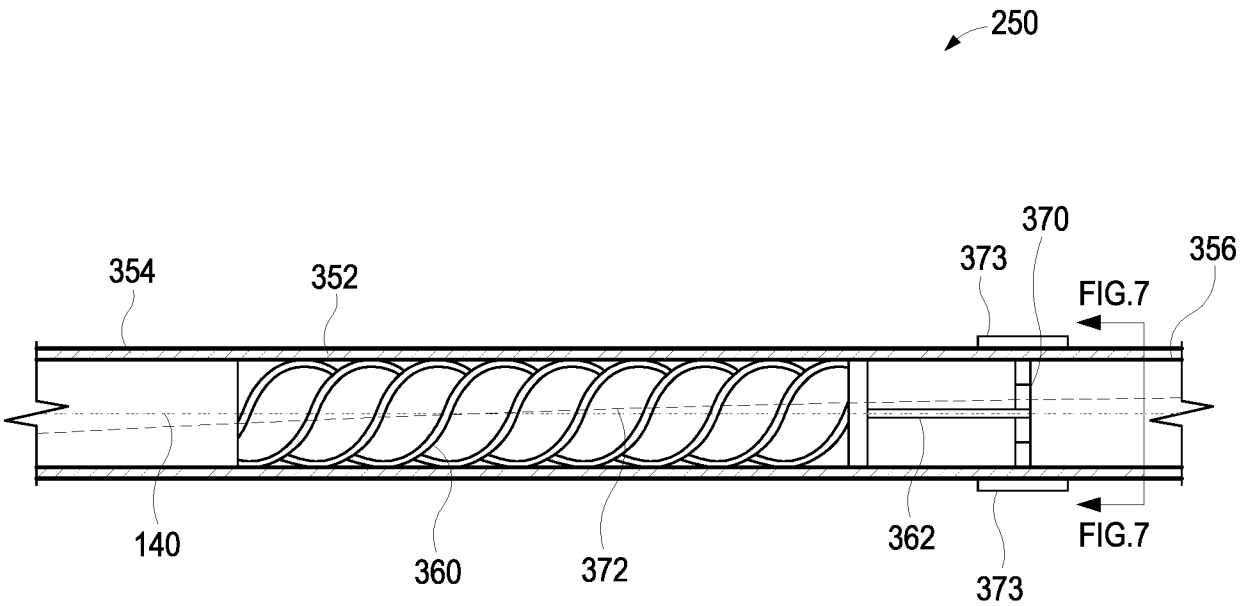
FIG. 6 is a cross-sectional view of an agitator, according to some embodiments of the present disclosure.

FIG. 6 is a cross-sectional view of an agitator 350, according to some embodiments of the present disclosure. Similar numerals from previous figures refer to similar components that are not described again for brevity. In the depicted example, the agitator 350 comprises a magnetic agitation mass 370.

Rotation of the rotor 360 can be imparted to the agitation mass 370 by a coupling member 362. The coupling member 362 can rotate with the rotor 360 to provide a rigid or compliant coupling to the agitation mass 370. The coupling member 362 can further axially space apart the agitation mass 370 from the rotor 360.

In some embodiments, the rotation of the agitation mass 370 creates a rotational imbalance to cause a periodic side force or vibration within the agitator 350, by pushing or pulling the agitation mass 370, for example, using magnetic forces, which is then transferred to the drill string 106. In the depicted example, the rotational path of the agitation mass 370 and the resulting side force or vibration can be affected or otherwise controlled by magnets 373 acting upon the agitation mass 370.

Figure 7:
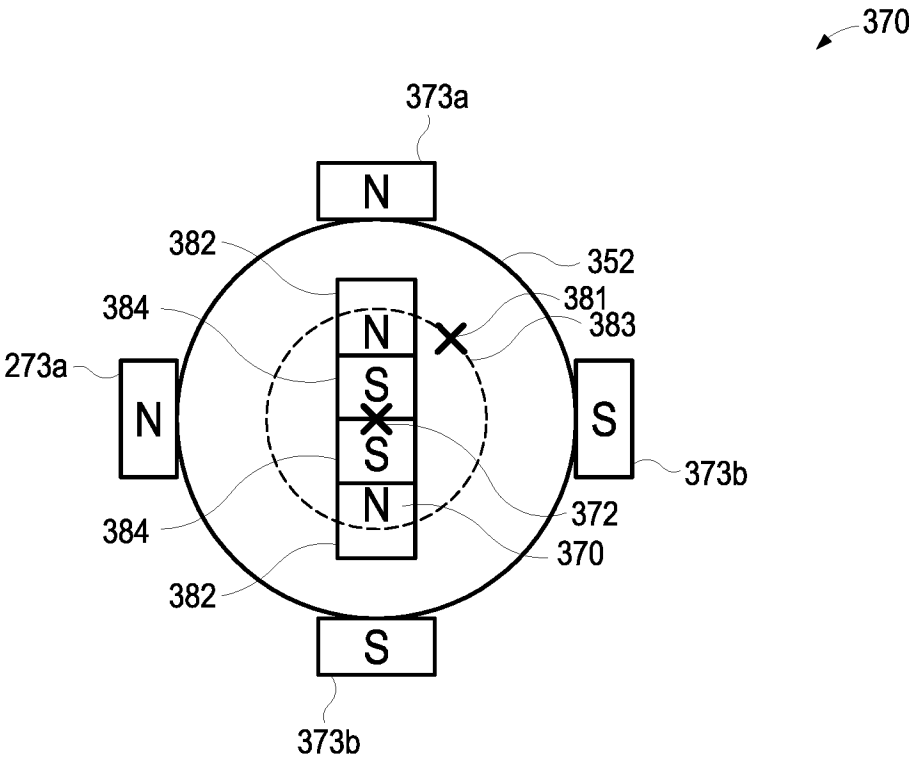
FIG. 7 is a sectional view of the agitator of FIG. 6, according to some embodiments of the present disclosure.

FIG. 7 is a sectional view of the agitator of FIG. 6, according to some embodiments of the present disclosure. In the depicted example, the agitation mass 370 rotates about the agitator axis 372. In the depicted example, as the agitation mass 370 is rotated, the agitation mass 370 is spaced apart from the agitator axis 372 to create a periodic side force or a rotational imbalance as the agitation mass 370 rotates.

As the agitation mass 370 rotates, the agitation mass 370 follows an eccentric path 383 about the agitator axis 372. The eccentric path 383 of the agitation mass 370 urges or forces the agitator axis 372 to deflect from the central axis 140 to create the desired vibration or side force from the agitator 350.

In the depicted example, the agitation mass 370 can comprise a magnetic member. The agitation mass 370 can be formed from any suitable magnetic material. In some embodiments, the agitation mass 370 can be formed from multiple magnets, each having a north pole 382 and a south pole 384. In some embodiments, multiple magnets can be arranged to form the agitation mass 370 wherein south poles 384 are disposed adjacent to each other and the north poles 382 are opposite each other. In some embodiments, the magnets of the agitation mass 370 can be arranged in any suitable arrangement.

In some embodiments, the center of mass 381 of the agitation mass 370 is located at or near the geometric center of the agitation mass 370. In some embodiments, the center of mass 381 is spaced apart from the geometric center of the agitation mass 370.

During rotation of the agitation mass 370, the poles 382 of the agitation mass 370 rotate past the magnets 373*a*, 373*b*. During rotation, the similar poles 382 and magnets 373*a* can repel the agitation mass 370 away from the magnets 373*a* while opposite poles 382 and magnets 373*b* can attract the agitation mass 370 toward the magnets 373*b*. This pushing or pulling of the agitation mass 370 can cause eccentric motion of the agitation mass 370 during rotation.

In some embodiments, the magnets 373*a*, 373*b* can be arranged in sequence to create a desired eccentric path 383 by sequentially attracting and repelling the poles 382 of the agitation mass 370. In the depicted example, the magnets 373*a*, 373*b* are disposed around the agitator housing 352. In some embodiments, the magnets are integrated into agitator housing. In some embodiments, the agitator housing 352 can be magnetic.

Therefore, when the agitation mass 370 is stationary, the center of mass 381 may be concentrically positioned with the agitator axis 372 and the central axis 140. However, as the agitation mass 370 is deflected onto the eccentric path 383 by the attraction and repulsion between the agitation mass 370 and the magnets 373*a*, 373*b*, the dynamic center of mass 381 of the agitation mass 370 can be on the eccentric path 383 relative to the agitator axis 372 and the central axis 140 to create a periodic vibration.

In some embodiments, the magnets 373*a*, 373*b*, and/or the magnets of the agitation mass 370 can be electromagnetic, ferromagnetic, or otherwise have the attraction/repulsion therebetween controlled to alter the eccentric path and the vibration created by the agitator 350.

Figure 8:
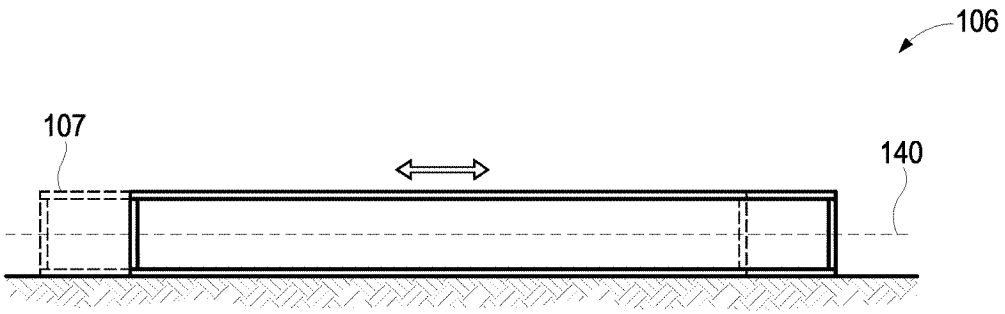
FIGS. 8-10 are cross-sectional views of a drill string, according to some embodiments of the present disclosure.

FIG. 8 is a cross-sectional view of a drill string, according to some embodiments of the present disclosure. In the depicted example, the drill string 106 is shown undergoing axial vibration along the central axis 140. As the drill string 106 is axially vibrated, the axial deflection of the drill string 106 is shown by the axial displacement 107.

Figure 9:
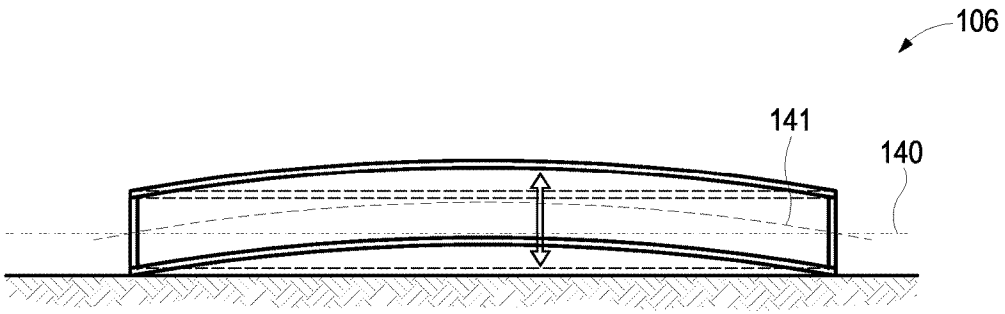

FIG. 9 is a cross-sectional view of a drill string, according to some embodiments of the present disclosure. In the depicted example, the drill string 106 is shown undergoing radial or lateral vibration. As the drill string 106 is radially vibrates, the radial deflection of the drill string 106 is shown by the radial displacement 141 compared to the central axis 140 of the drill string 106.

During radial or lateral vibration of the drill string, the drill string will deflect with a deflection $d_o$ in a sinusoidal manner as described by the following equation:

$$d_o = -\frac{a_o}{\omega^2}\sin\omega t$$

wherein $a_o$ is an initial amplitude of deflection and $\omega$ is an angular velocity of the drill string 106. Advantageously, as the drill string 106 deforms in a sinusoidal shape, less surface area of the drill string 106 is in contact with the wellbore, greatly minimizing friction forces on the drill string 106.

Figure 10:
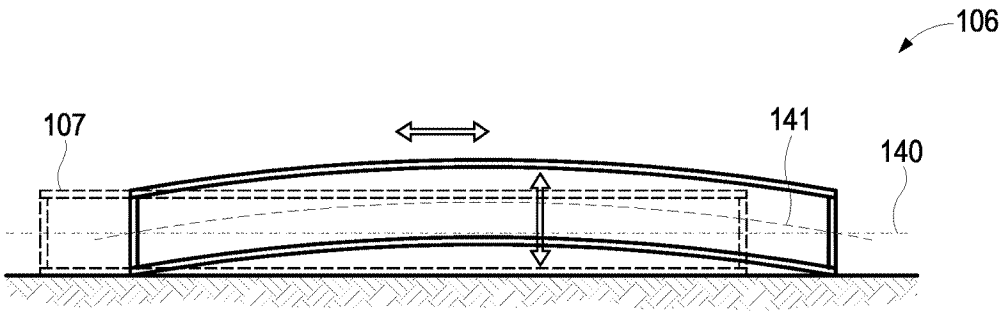

FIG. 10 is a cross-sectional view of a drill string, according to some embodiments of the present disclosure. In the depicted example, the drill string 106 is shown undergoing radial or lateral vibration in addition to axial vibration. As the drill string 106 is radially vibrates, the radial deflection of the drill string 106 is shown by the radial displacement 141 compared to the central axis 140 of the drill string 106 and the axial deflection of the drill string 106 is shown by the axial displacement 107. Advantageously, radial vibration can be combined with axial vibration of the drill string 106 without any coupled or supplemental vibration modes.

Various examples of aspects of the disclosure are described below as clauses for convenience. These are provided as examples, and do not limit the subject technology.

Clause 1. An agitator for vibrating a drill string, the drill string defining a central axis, the agitator comprising an agitator housing configured for connection in-line to a drill string; a rotor coupled to the agitator housing and being rotatable about an agitator axis; and an agitation mass coupled to the rotor to be rotatable about the agitator axis, wherein during rotation, a center of mass of the agitation mass is spaced apart from the agitator axis, wherein, wherein movement of the center of mass of the agitation mass is operative to cause deflection of the agitator axis relative to a central axis of the drill string to produce a vibration in the drill string.

Clause 2. The agitator of Clause 1, wherein the center of mass is spaced apart from the agitator axis.

Clause 3. The agitator of any preceding clause, wherein the agitation mass comprises a disc.

Clause 4. The agitator of Clause 3, wherein the disc includes an eccentric distribution of mass.

Clause 5. The agitator of Clause 3, wherein the disc includes a high density portion.

Clause 6. The agitator of Clause 3, wherein the disc includes a low density portion.

Clause 7. The agitator of any preceding clause, wherein the agitation mass comprises a sphere.

Clause 8. The agitator of Clause 7, wherein the sphere is rotatable about an eccentric path about the central axis.

Clause 9. The agitator of any preceding clause, wherein the agitation mass is magnetic.

Clause 10. The agitator of any preceding clause, wherein the agitator comprises a magnet.

Clause 11. The agitator of Clause 10, wherein the agitator comprises an electromagnet.

Clause 12. The agitator of Clause 10, wherein the magnet comprises north and south poles aligned at opposing circumferential locations about the agitator axis relative to the agitation mass.

Clause 13. The agitator of any preceding clause, wherein the agitation mass is disposed within an agitator housing.

Clause 14. An agitator for vibrating a drill string, the drill string defining a central axis, the agitator comprising: a rotor defining an agitator axis and being rotatable about the agitator axis; and an agitation mass coupled to the rotor to be rotatable about the agitator axis, the agitation mass having a center of mass spaced apart from the agitator axis to deflect the agitator axis relative to the central axis during rotation of the agitation mass to produce a vibration in the drill string.

Clause 15. The agitator of Clause 14, further comprising a coupling mechanism coupling to the agitation mass, wherein rotation of the rotor about the central axis drives rotation of the agitation mass about the central axis.

Clause 16. The agitator of Clause 15, wherein the coupling mechanism is rigid.

Clause 17. The agitator of Clause 15, wherein the coupling mechanism is movable to allow radial movement of the agitation mass relative to the rotor.

Clause 18. The agitator of Clause 15, wherein the coupling mechanism comprises a spring.

Clause 19. The agitator of Clauses 14-17, wherein the agitation mass comprises a disc.

Clause 20. The agitator of Clause 19, wherein the disc includes an eccentric distribution of mass.

Clause 21. The agitator of Clause 19, wherein the disc includes a high density portion.

Clause 22. The agitator of Clause 19, wherein the disc includes a low density portion.

Clause 23. The agitator of Clauses 14-21, wherein the agitation mass comprises a sphere.

Clause 24. The agitator of Clause 23, wherein the sphere is rotatable about an eccentric path about the central axis.

Clause 25. The agitator of Clauses 14-24, further comprising a motor including the rotor.

Clause 26. The agitator of Clause 25, wherein the motor comprises an electric motor.

Clause 27. The agitator of Clause 25, wherein the motor comprises a mud motor.

Clause 28. The agitator of Clauses 14-27, wherein the agitation mass is disposed within an agitator housing.

Clause 29. A method for vibrating a drill string, the drill string having a central axis, the method comprising: rotating an agitation mass within the drill string about the central axis, wherein the agitation mass includes a center of mass radially spaced apart from the central axis during rotation; radially vibrating the drill string at a location adjacent to the agitation mass within the drill string; and axially translating the drill string within a wellbore.

Clause 30. The method of Clause 29, wherein the radially vibrating is periodic.

Clause 31. The method of Clause 29 or 30, wherein the agitation mass comprises a disc.

Clause 32. The method of Clause 31, wherein the disc includes an eccentric distribution of mass.

Clause 33. The method of Clause 31, wherein the disc includes a high density portion.

Clause 34. The method of Clause 31, wherein the disc includes a low density portion.

Clause 35. The method of Clauses 29-34, wherein the agitation mass comprises a sphere.

Clause 36. The method of Clause 35, further comprising rotating the sphere about an eccentric path about the central axis.

Clause 37. The method of Clauses 29-36, wherein the agitation mass is magnetic.

Clause 38. The method of Clause 37, further comprising directing the agitation mass about an eccentric path about the central axis via an electromagnet.

Clause 39. A well system for use with a wellbore, the well system comprising: a drill string having a central axis disposed within the wellbore, wherein the drill string is axially translatable within the wellbore; and an agitator disposed within the drill string, the agitator comprising: a rotor defining an agitator axis and being rotatable about the agitator axis; and an agitation mass coupled to the rotor to be rotatable about the agitator axis, the agitation mass having a center of mass spaced apart from the agitator axis to deflect the agitator axis relative to the central axis during rotation of the agitation mass to produce a vibration in the drill string.

Clause 40. The well system of Clause 39, further comprising a coupling mechanism coupling the rotor to the agitation mass, wherein rotation of the rotor about the central axis drives rotation of the agitation mass about the central axis.

Clause 41. The well system of Clause 40, wherein the coupling mechanism is rigid.

Clause 42. The well system of Clause 40, wherein the coupling mechanism is movable to allow radial movement of the agitation mass relative to the rotor.

Clause 43. The well system of Clause 40, wherein the coupling mechanism comprises a spring.

Clause 44. The well system of Clauses 39-43, wherein the agitation mass comprises a disc.

Clause 45. The well system of Clause 44, wherein the disc includes an eccentric distribution of mass.

Clause 46. The well system of Clause 44, wherein the disc includes a high density portion.

Clause 47. The well system of Clause 44, wherein the disc includes a low density portion.

Clause 48. The well system of Clauses 39-47, wherein the agitation mass comprises a sphere.

Clause 49. The well system of Clause 48, wherein the sphere is rotatable about an eccentric path about the central axis.

Clause 50. The well system of Clauses 39-49, further comprising a motor including the rotor.

Clause 51. The well system of Clause 50, wherein the motor comprises an electric motor.

Clause 52. The well system of Clause 50, wherein the motor comprises a mud motor.

Clause 53. The well system of Clauses 39-52, wherein the agitator includes a plurality of agitators.

Clause 54. The well system of Clauses 39-53, wherein the agitation mass is disposed within an agitator housing.

Clause 55. An agitator for vibrating a drill string, the drill string having a central axis, the agitator comprising: an agitation mass rotatable about the central axis and having a center of mass spaced apart from the central axis to deflect a position of the agitator upon rotation of the agitation mass about the central axis.

Clause 56. The agitator of Clause 55, wherein the agitation mass comprises a disc.

Clause 57. The agitator of Clause 55 or 56, wherein the disc includes an eccentric distribution of mass.

Clause 58. The agitator of Clauses 55-57, wherein the disc includes a high density portion.

Clause 59. The agitator of Clauses 55-58, wherein the disc includes a low density portion.

Clause 60. The agitator of Clauses 55-69, wherein the agitation mass comprises a sphere.

Clause 61. The agitator of Clauses 55-60, wherein the sphere is rotatable about an eccentric path about the central axis.

Clause 62. The agitator of Clauses 55-61, wherein the agitation mass is disposed within an agitator housing.

Clause 63. An agitator for vibrating a drill string, the drill string defining a central axis, the agitator comprising: a magnetic agitation mass rotatable about the central axis, having a center of mass; and a magnetic stator fixed relative to the magnetic agitation mass, the magnetic stator to attract the magnetic agitation mass to deflect a position of the agitator upon rotation of the magnetic agitation mass about the central axis.

Clause 64. The agitator of Clause 63, wherein the magnetic stator includes a plurality of magnetic stators.

Clause 65. The agitator of Clause 63 or 64, wherein the magnetic agitation mass is disposed within an agitator housing.

What is claimed is:

1. An agitator for vibrating a drill string, comprising:

an agitator housing configured for connection in-line to a drill string;

a rotor coupled to the agitator housing and being rotatable about an agitator axis;

a coupling mechanism having a proximal end secured to the rotor, wherein the coupling mechanism comprises a spring; and an agitation mass coupled to the rotor via the coupling mechanism, wherein the agitation mass is secured to a distal end of the coupling mechanism, and wherein the agitation mass is rotatable about the agitator axis, wherein during rotation, a center of mass of the agitation mass is spaced apart from the agitator axis, wherein movement of the center of mass of the agitation mass is operative to cause deflection of the agitator axis relative to a central axis of the drill string to produce a vibration in the drill string.

2. The agitator of claim 1, wherein the agitation mass comprises a disc.

3. The agitator of claim 2, wherein the disc includes an eccentric distribution of mass.

4. The agitator of claim 2, wherein the disc includes a high density portion.

5. The agitator of claim 1, wherein the agitation mass comprises a weighted sphere.

6. The agitator of claim 5, wherein the sphere is rotatable about an eccentric path about the central axis.

7. The agitator of claim 1, wherein the agitation mass is magnetic.

8. The agitator of claim 1, wherein the agitator comprises a magnet.

9. The agitator of claim 8, wherein the magnet comprises north and south poles aligned at opposing circumferential locations about the agitator axis relative to the agitation mass.

10. An agitator for vibrating a drill string, the drill string defining a central axis, the agitator comprising:

a rotor defining an agitator axis and being rotatable about the agitator axis;

a coupling mechanism having a proximal end secured to a downhole end of the rotor; and an agitation mass coupled to the rotor via the coupling mechanism, wherein the agitation mass is secured to a distal end of the coupling mechanism such that the agitation mass is axially offset from the rotor, wherein the coupling mechanism is movable to allow radial movement of the agitation mass relative to the rotor, and wherein the agitation mass is rotatable about the agitator axis, the agitation mass having a center of mass spaced apart from the agitator axis to deflect the agitator axis relative to the central axis during rotation of the agitation mass to produce a vibration in the drill string.

11. The agitator of claim 10, wherein the coupling mechanism is rigid.

12. The agitator of claim 10, wherein rotation of the rotor about the central axis drives rotation of the agitation mass about the central axis.

13. The agitator of claim 10, wherein the coupling mechanism comprises a spring.

14. A method for vibrating a drill string, the drill string having a central axis, the method comprising:

rotating an agitation mass, via a rotor, within the drill string about the central axis, wherein the agitation mass includes a center of mass radially spaced apart from the central axis during rotation, and wherein the agitation mass is coupled to a downhole end of the rotor via a coupling mechanism such that the agitation mass is axially offset from the rotor, wherein the coupling mechanism comprises a spring;

radially vibrating the drill string at a location adjacent to the agitation mass within the drill string; and axially translating the drill string within a wellbore.

15. The method of claim 14, wherein the radially vibrating is periodic.

16. The method of claim 14, wherein the agitation mass comprises a sphere.

17. The method of claim 16, further comprising rotating the sphere about an eccentric path about the central axis.

18. The method of claim 14, wherein the agitation mass is magnetic.

19. The method of claim 18, further comprising directing the agitation mass about an eccentric path about the central axis via an electromagnet.

* * * * *